US006321497B1

(12) United States Patent
Cormier

(10) Patent No.: US 6,321,497 B1
(45) Date of Patent: Nov. 27, 2001

(54) WEB FOR INSULATED CONCRETE FORM

(75) Inventor: Mario Robert Cormier, Surrey (CA)

(73) Assignee: First Choice Manufacturing Ltd., Surrey (CA)

( * ) Notice: Subject to any disclaimer, the term of this patent is extended or adjusted under 35 U.S.C. 154(b) by 0 days.

(21) Appl. No.: 09/241,387

(22) Filed: Feb. 2, 1999

(51) Int. Cl.[7] ..... E04B 2/46

(52) U.S. Cl. ..... 52/425; 52/426; 52/562; 52/563; 52/565

(58) Field of Search ..... 52/425, 426, 562, 52/563, 565, 438, 442, 713, 714; 249/40, 190

(56) References Cited

U.S. PATENT DOCUMENTS

| | | | | |
|---|---|---|---|---|
| 878,000 | * | 2/1908 | Holman | 52/426 |
| 1,035,206 | * | 8/1912 | Lewen | 52/426 X |
| 1,468,285 | * | 9/1923 | Dampney | 52/713 |
| 2,009,513 | * | 7/1935 | Oliver | 52/713 |
| 2,640,249 | * | 6/1953 | Symons | 52/426 |
| 4,660,342 | * | 4/1987 | Salisbury | 52/713 X |
| 4,888,931 | * | 12/1989 | Meilleur | 52/426 |
| 4,901,494 | * | 2/1990 | Miller et al. | 52/309.12 |
| 4,972,646 | * | 11/1990 | Miller et al. | 52/293 |
| 5,140,794 | * | 8/1992 | Miller | 52/309.12 |
| 5,459,970 | * | 10/1995 | Kim | 52/424 |
| 5,528,876 | * | 6/1996 | Lu | 52/654.1 |
| 5,671,578 | * | 9/1997 | Hohmann | 52/713 X |
| 5,845,445 | * | 12/1998 | Blackbeard | 52/426 |
| 5,845,455 | * | 12/1998 | Johnson, III | 52/713 |

* cited by examiner

*Primary Examiner*—Carl D. Friedman
*Assistant Examiner*—Phi Dieu Tran A
(74) *Attorney, Agent, or Firm*—Elbie R. de Kock

(57) ABSTRACT

A web (10) for an insulated concrete form (20) comprises a pair of opposed web elements (12) and a pair of connectors (14). The web elements (12) and the connectors (14) are provided with mutually interengaging formations, such as a non-circular tube (12.1) and V-shaped hook formations (14.1), whereby the web element (12) and the connectors (14) are rigidly connected together in a plane to form a stable structure.

9 Claims, 5 Drawing Sheets

WEB FOR INSULATED CONCRETE FORM

FIELD OF THE INVENTION

This invention relates to an insulated concrete form and, in particular, to a web for an insulated concrete form.

BACKGROUND OF THE INVENTION

Insulated concrete forms allow concrete foundations and walls to be poured and insulated at the same time. Each form comprises a pair of spaced foam panels separated by webs extending between the panels.

The webs are important in that they should be sturdy enough to provide a form that is stable and strong and yet does not interfere with the pouring of the concrete into the form.

It is accordingly an object of the present invention to provide a web for an insulated concrete form which satisfies the above requirements.

SUMMARY OF THE INVENTION

According to the invention there is provided a web for an insulated concrete form comprising a pair of opposed web elements and a pair of connectors for connecting the web elements together in spaced relationship, the web elements and the connectors being provided with mutually interengaging formations whereby the web elements and the connectors are rigidly held together in a plane.

Each web element may comprise a flat strip provided with a non-circular tube on one side forming said mutually interengaging formation on the web element for engaging with one of the connectors.

Each connector may comprise a steel bar and wherein said mutually interengaging formations on the connector comprise V-shaped or U-shaped hook formations at its opposite ends, respectively, for engaging with the non-circular tube on each of said opposed web elements.

Also according to the invention there is provided an insulated concrete form comprising a pair of opposing panels of a thermal insulating material which are connected together in spaced relationship by means of a plurality of the webs as described.

Further objects and advantages of the invention will become apparent from the description of preferred embodiments of the invention below.

BRIEF DESCRIPTION OF THE DRAWINGS

The invention will now be described, by way of example, with reference to the accompanying drawings, in which.

DETAILED DESCRIPTION OF PREFERRED EMBODIMENTS

Figure 3:
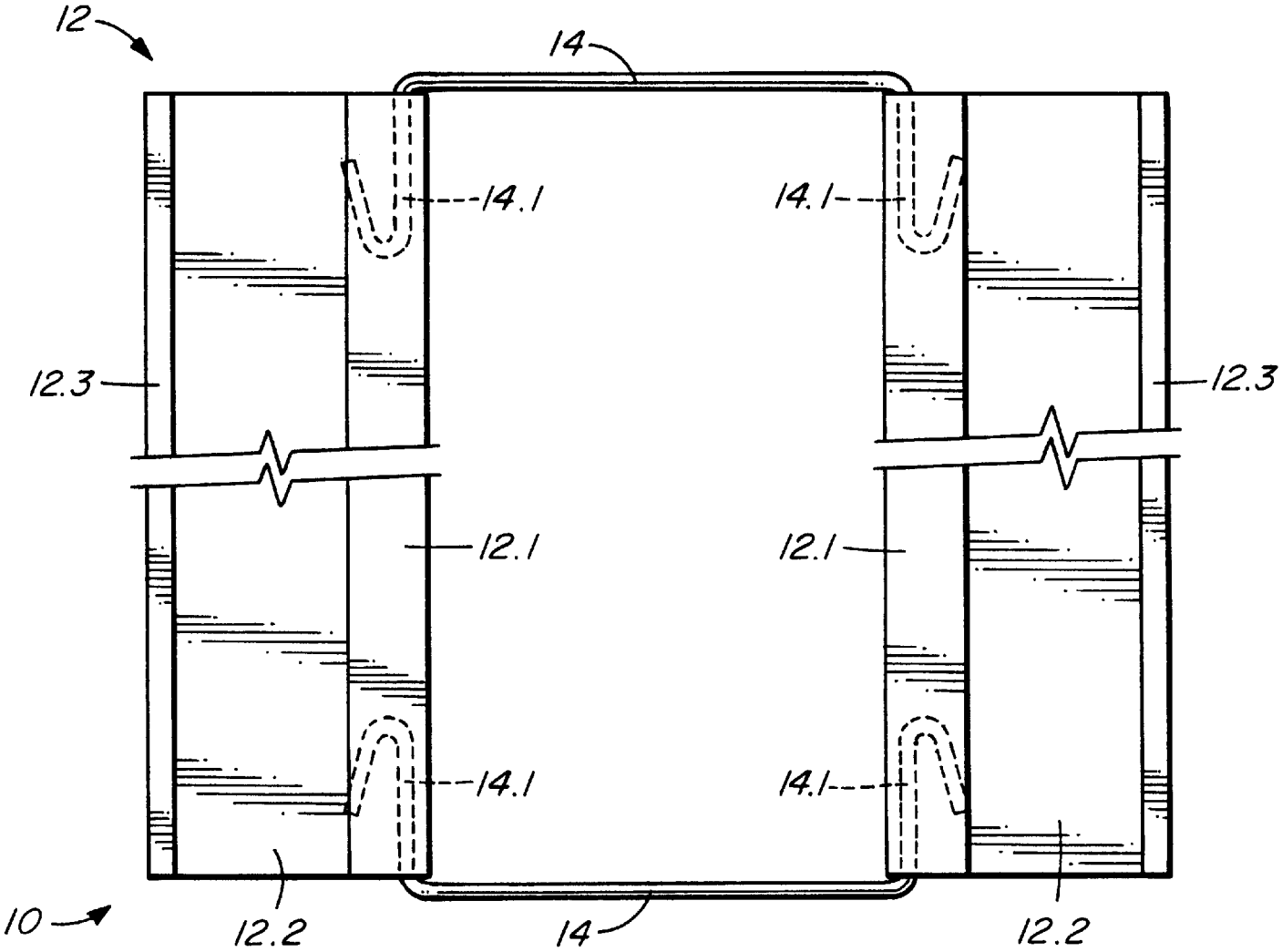
FIG. 3 is a plan view showing a pair of the web elements of FIG. 1 connected together by two of the connectors of FIG. 2 to form a web.

In FIG. 3, reference numeral 10 generally indicates a web comprising a pair of web elements or furring strips 12 which are connected together by means of a pair of connectors 14.

Figure 1:
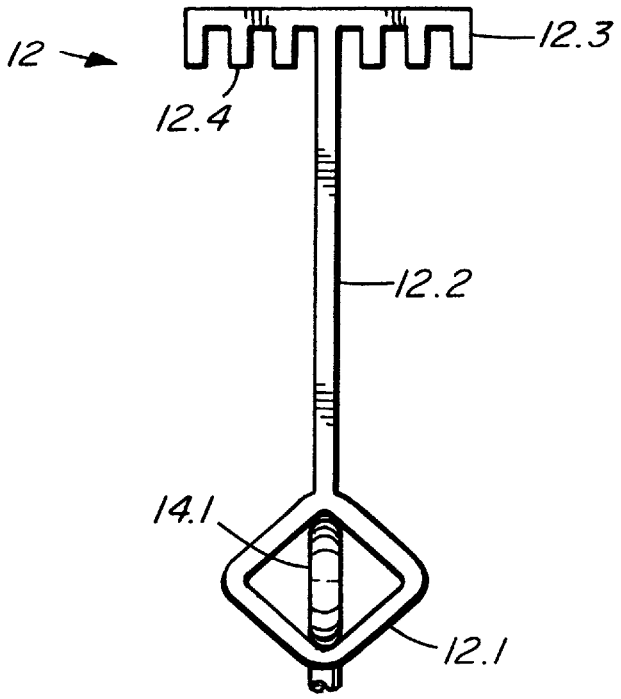
FIG. 1 is an end view of a web element for an insulated concrete form.

An end view of a furring strip 12 is shown in FIG. 1. It is of a high density plastic. On one side of the strip 12, the plastic is shaped into a diamond-shaped tube 12.1. Extending from the tube 12.1 is a flat section 12.2 which is 1.8" in width. At the opposite side of the flat section 12.2, the plastic is formed into a bar 12.3 which is 0.975" in width. As shown, the bar 12.3 is flat on the outside and has six ribs 12.4 on the inside, each rib 12.4 being ⅛" deep.

Figure 2:
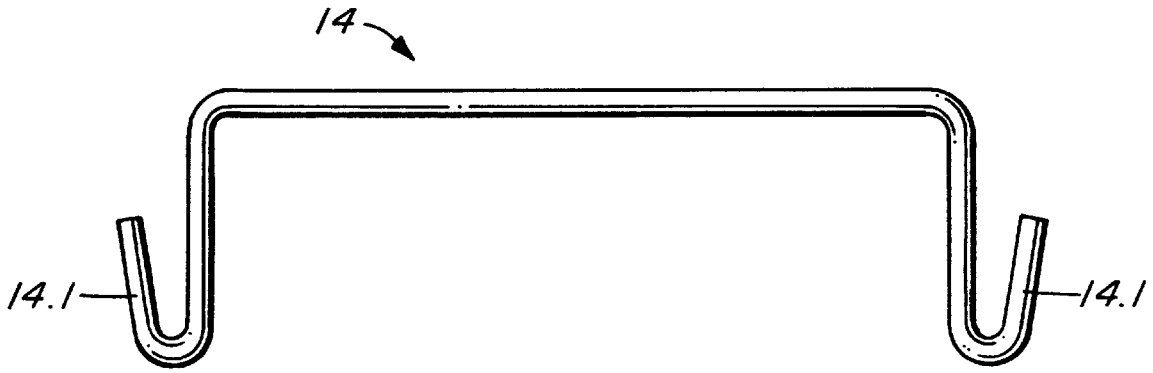
FIG. 2 is a plan view of a connector for connecting a pair of the web elements of FIG. 1 together to form a web.

A connector is shown in FIG. 2. It comprises a bar of 9 gauge galvanised steel.

The connector 14 is formed into a V-shaped hook 14.1 at each end. The hooks 14.1 are inserted into the diamond-shaped tube 12.1 and engage with the opposite corners of the diamond shape, as shown in FIGS. 1 and 3. This provides for rigidity and stability in the plane of the web 10, i.e. the strips 12 cannot move or rotate relative to each other. Once the hooks 14.1 are inserted, they lock the connector 14 into place and are difficult to remove from the diamond-shaped tube 12.1.

Figure 4:
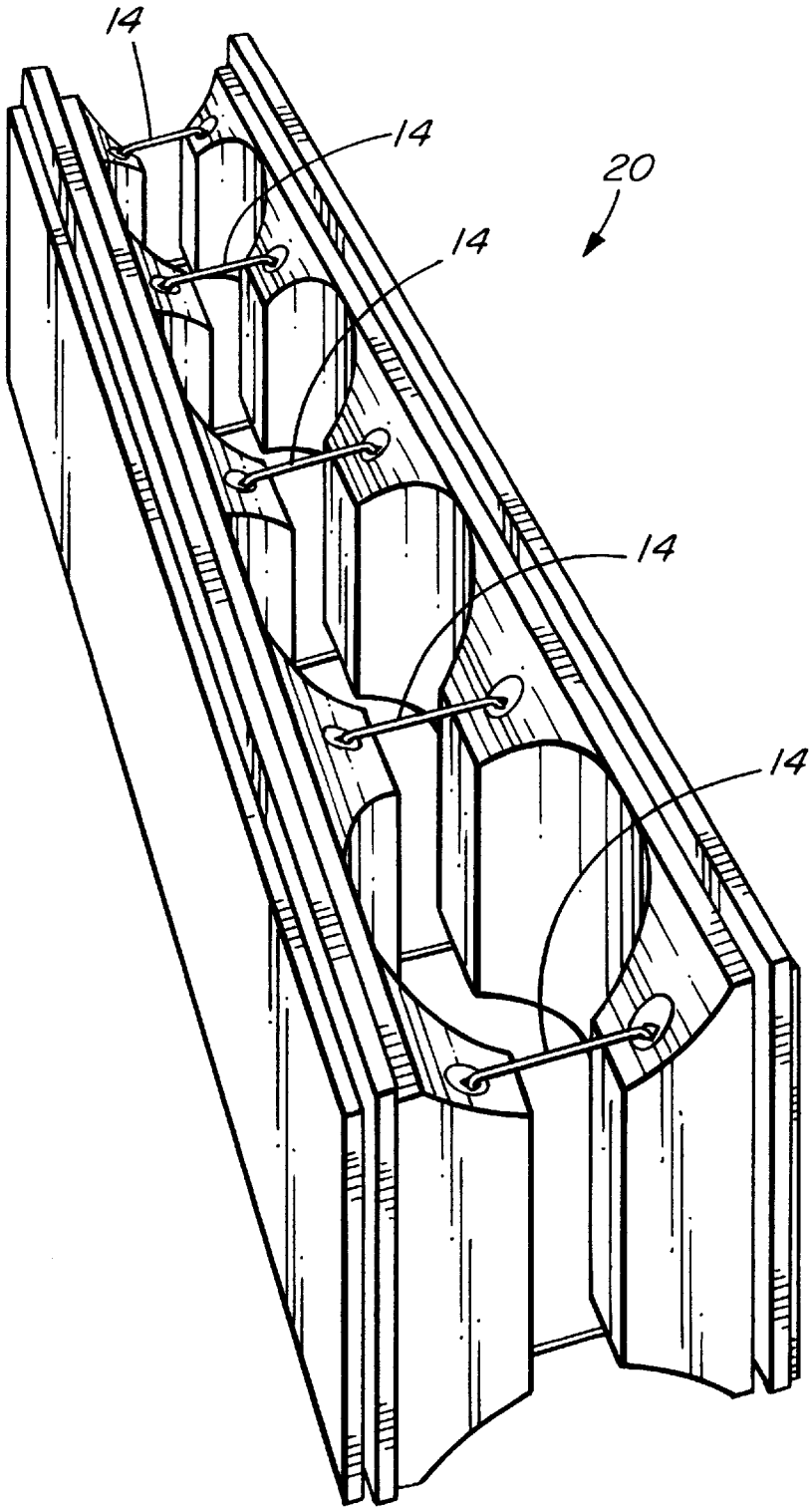
FIG. 4 is a perspective view of an insulated concrete form which has been manufactured using five of the webs of FIG. 3.
Figure 5:
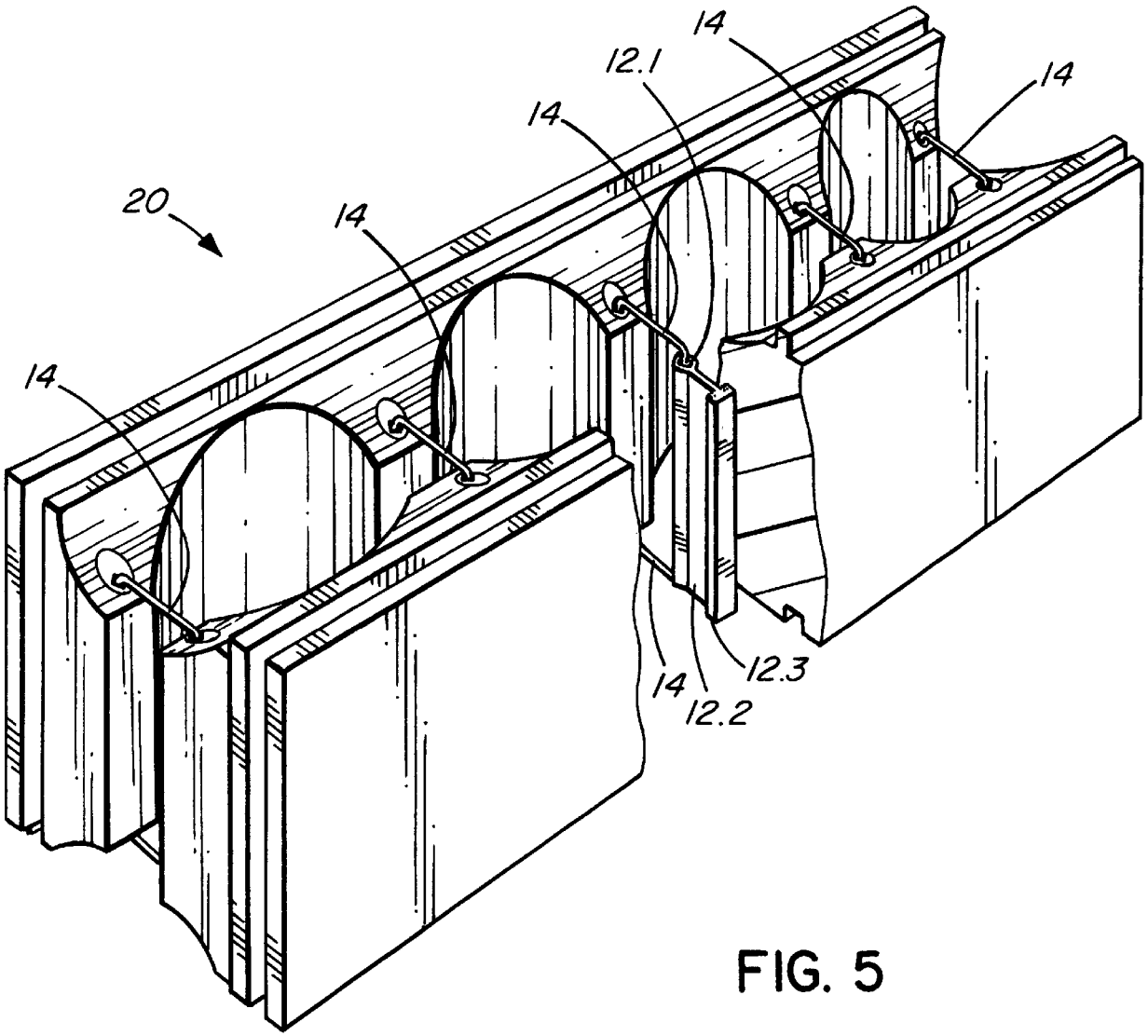
FIG. 5 is another perspective view of the insulated concrete form of FIG. 4 with a part of the side cut away to show the web.
Figure 6:
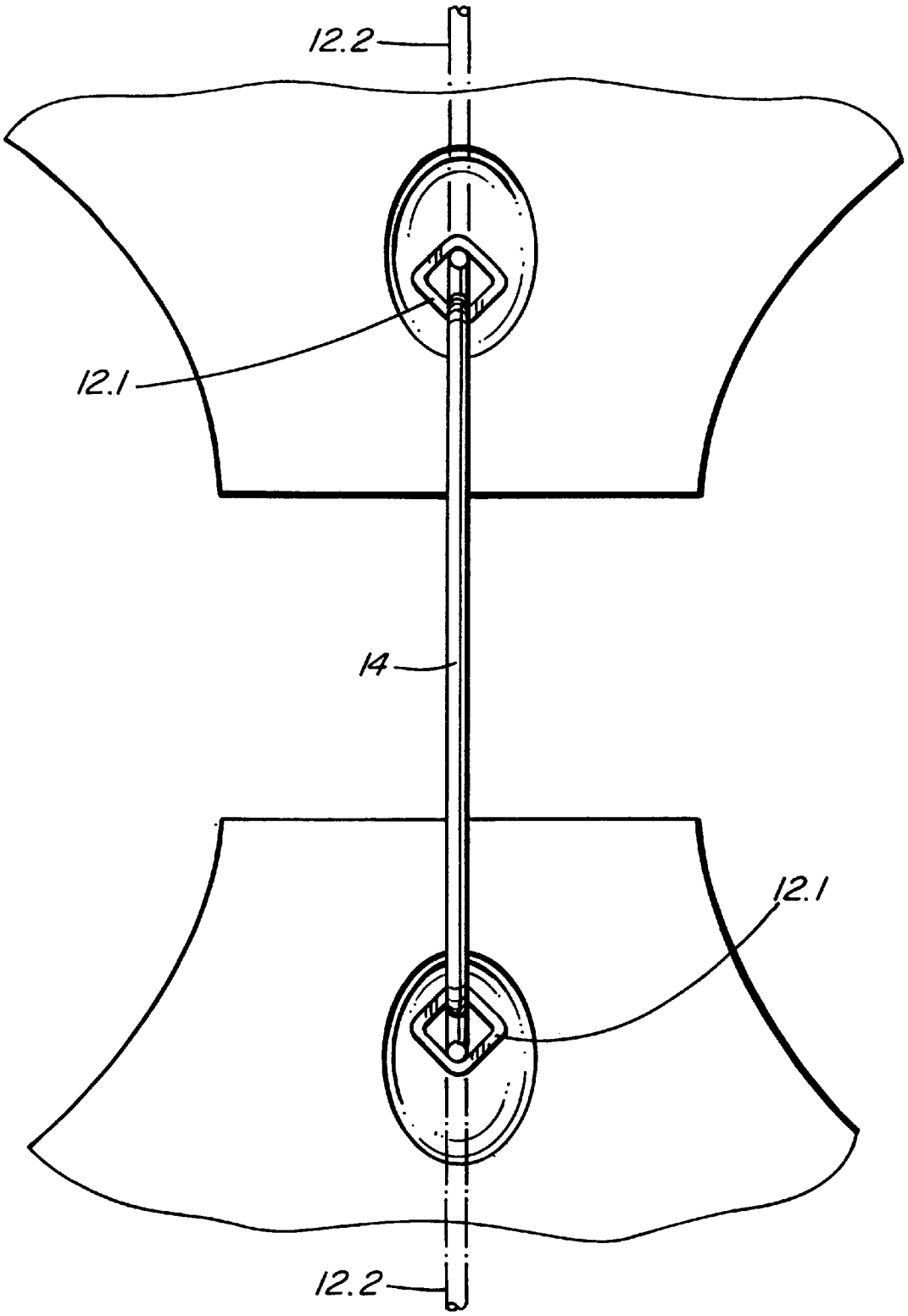
FIG. 6 is a close-up view of the insulated concrete form of FIG. 4 showing how the web is embedded.

An insulated concrete form 20 is formed using several of the webs 10, as shown in FIGS. 4 to 6.

The form 20 comprises a pair of opposing panels 22 of expanded polystyrene connected together in spaced parallel relationship by the webs 10. The strips 12 of the webs 10 are embedded in the polystyrene during the moulding of each panel 22. For this purpose, the mould that is used for producing the panels 22 is provided with a long prong for each furring strip 12. The tube 12.1 slides over the prong to locate each furring strip 12 in position in the mould.

The mould is then closed and the mould cavity is filled with expanded polystyrene which then completely encases the furring strips 12. Only the openings of the tubes 12.1 are visible after the moulding is completed, as shown in FIG. 6.

The furring strip 12 is embedded so that the flat side of the bar 12.3 is about ½" from the outside wall of the panel 22. Since the steel connector 14 is engaged with the plastic tube 12.1, which only has minimal thermal conductivity, and the bar 12.3 is located ½" away from the outside wall of the panel 22, a full thermal break is obtained. Therefore, the conductivity of heat or cold through a wall constructed with the insulated concrete forms 20 is effectively counteracted.

After moulding, the panels 22 are joined together by the connectors 14 which are inserted into the diamond-shaped tubes 12.1, as described above. The form 20 can therefore easily be assembled, either on or off the job site, which allows for larger shipments of the form 20, saving delivery costs. The connection of the connectors 14 may also be effected while the panels 22 are still warm after ejection from the mould.

The strip 12 is manufactured (extruded) in continuous form and is then cut into the required length, depending on the depth of the form 20 that is being made.

As shown, the form 20 is provided with tongue 20.1 and groove 20.2 formations for easy placement of adjacent forms 20.

In use, the forms 20 are placed on the foundation of a building being constructed. Steel reinforcing bars are placed in the forms 20 and the forms 20 are then filled with concrete. The web 10 provides for faster flow of the concrete because it does not form an obstruction inside the form 20, thus counteracting the formation of weak spots, such as air pockets.

The form 20 can also be used for forming the foundation and for this purpose can be provided in a larger size than a form intended for use in forming a wall. The form 20 can be provided for a variety of wall and foundation widths, ranging from 4" wide to 32" wide.

The form 20 also allows for stucco applications to be uniform in density and counteracts cracking of the stucco because the web elements 12 are completely encased within the form panels 22.

The flat outside of the bar 12.3 on the furring strip 12 is to accommodate the attachment of interior and exterior sheeting to the walls, while the ribs 12.4 improve the strength of the bar 12.3 and also provide for more securely embedding the bar 12.3 inside the panel 22.

While only preferred embodiments of the invention have been described herein in detail, the invention is not limited thereby and modifications can be made within the scope of the attached claims.

What is claimed is:

1. A web for an insulated concrete form, comprising:

a pair of opposed web elements arranged in a co-planar dimension, each web element having a pair of opposite ends and a side extending between the ends, a pair of connectors connecting the web elements together with the side of one web element being arranged in opposed spaced relationship with the side of the other web element and with the ends of the respective web elements being arranged in aligned pairs, each connector extending from the end of one web element to the corresponding aligned end of the other web element, the web elements and connectors further being provided with mutually interengaging formations, whereby the web elements and the connectors are rigidly held together in one plane, the mutually interengaging formations on the web elements being located on said opposite ends of the web elements wherein each web element is provided with a tube extending along said side of the web element, the tube having opposite ends located at the opposite ends of the web element, said ends of the tube forming the mutually interengaging formations on the web element engaging with the connectors.

2. The web according to claim 1, wherein each connector comprises a steel bar and wherein said mutually interengaging formations on the connector comprise V-shaped hook formations at its opposite ends, respectively, engaging with the tube on each of said opposed web elements.

3. The web according to claim 1, wherein each web element further comprises a transverse bar opposite to said tube, said bar having a side facing the tube which is provided with a plurality of longitudinal ribs.

4. The web according to claims 3, wherein the bar has a substantially flat side facing away from said tube.

5. The web element according to claim 1, wherein each web element is of a high density plastic.

6. An insulated concrete form comprising a pair of opposing panels of a thermal insulating material which are connected together in spaced relationship by means of a plurality of the webs of claim 1.

7. The insulated concrete form according to claim 6, wherein said web elements are embedded in the panels of insulating material.

8. The web according to claim 1, wherein the tube is non-circular.

9. The web according to claim 1, wherein the non-circular tube has a diamond-shaped cross-section.

* * * * *